US008071521B2

(12) United States Patent
Konishi et al.

(10) Patent No.: US 8,071,521 B2
(45) Date of Patent: Dec. 6, 2011

(54) LIQUID DETERGENT COMPOSITION

(75) Inventors: Yoshihiro Konishi, Wakayama (JP); Yoshimasa Okamoto, Wakayama (JP); Masahiro Suzuki, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 12/742,273

(22) PCT Filed: Nov. 28, 2008

(86) PCT No.: PCT/JP2008/072101

§ 371 (c)(1),
(2), (4) Date: May 11, 2010

(87) PCT Pub. No.: WO2009/069826

PCT Pub. Date: Jun. 4, 2009

(65) Prior Publication Data

US 2010/0256035 A1 Oct. 7, 2010

(30) Foreign Application Priority Data

Nov. 30, 2007 (JP) ..... 2007-310893

(51) Int. Cl.
*C11D 1/29* (2006.01)
*C11D 1/75* (2006.01)
*C11D 3/43* (2006.01)

(52) U.S. Cl. ..... 510/237; 510/426; 510/427; 510/428; 510/503; 510/506; 134/25.2

(58) Field of Classification Search ..... 510/237, 510/426, 427, 428, 503, 506; 134/25.2
See application file for complete search history.

(56) References Cited

U.S. PATENT DOCUMENTS

| | | | | |
|---|---|---|---|---|
| 4,395,364 | A | 7/1983 | Murata et al. | |
| 6,008,181 | A | 12/1999 | Cripe et al. | |
| 2003/0154556 | A1 * | 8/2003 | Del Duca et al. | 8/115.51 |

FOREIGN PATENT DOCUMENTS

| | | | |
|---|---|---|---|
| EP | 0 855 438 | A1 | 7/1998 |
| JP | 55-84399 | A | 6/1980 |
| JP | 56-5895 | A | 1/1981 |
| JP | 56-72092 | A | 6/1981 |
| JP | 5-97633 | A | 4/1993 |
| JP | 11-507955 | A | 7/1999 |
| JP | 2002-194388 | A | 7/2002 |
| JP | 2003-328287 | A | 11/2003 |
| JP | 2007-23211 | A | 2/2007 |
| WO | WO 97/39087 | A1 | 10/1997 |

OTHER PUBLICATIONS

International Search Report mailed Mar. 3, 2009 in International Application No. PCT/JP2008/072101.

International Preliminary Report on Patentability and Written Opinion of the International Searching Authority (Forms PCT/IB/338, PCT/IB/373 and PCT/ISA/237) mailed Aug. 19, 2010 for International Application No. PCT/JP2008/072101.

Office Action issued Jul. 1, 2011, in Chinese Patent Application No. 200880118386.9 (with English translation).

Extended European Search Report mailed Apr. 27, 2011, in European Patent Application No. 08854845.8.

* cited by examiner

*Primary Examiner* — Gregory Delcotto
(74) *Attorney, Agent, or Firm* — Birch, Stewart, Kolasch & Birch, LLP

(57) ABSTRACT

The present invention provides a liquid detergent composition, containing (a) 4 to 50% by mass of a mixture containing specific polyoxyalkylene alkyl ether sulfates represented by formula (1) having average addition mole numbers m and n of propylene oxide and ethylene oxide satisfying $0<m<1$ and $0<n\leqq 3$, respectively; (b) 1 to 30% by mass of an amine oxide surfactant having a hydrocarbon group having 8 to 18 carbon atoms and an alkyl group having 1 to 3 carbon atoms or a hydroxyalkyl group having 1 to 3 carbon atoms; a phase stabilizer selected from hydrotrope agents and organic solvents; and water, wherein a mass ratio of (a)/(b) is 20/1 to 1/1.

4 Claims, No Drawings

LIQUID DETERGENT COMPOSITION

FIELD OF THE INVENTION

The present invention relates to a liquid detergent composition, particularly to a liquid detergent composition containing an anion surfactant produced from a natural materials as a main surfactant, and more particularly to a liquid detergent composition suitable for cleaning hard surfaces such as kitchen facilities, particularly dishes and cooking devices.

BACKGROUND OF THE INVENTION

From the viewpoint of reduction of environmental burdens, concentrated liquid detergents that contain surfactants at increased concentration and are packed in containers made of reduced amounts of resins have been recently preferred and used. For body-washes and liquid detergents for dishes, from the viewpoint of detergency and prevention of roughness of the hand skin, many of them use an anionic surfactant, i.e., polyoxyalkylene alkyl ether sulfate surfactant (hereinafter, also referred to as AES), as a main component. Particularly, liquid detergents for dishes, from the viewpoint of foaming and foam-lasting property in washing, generally use together an amine oxide surfactant (hereinafter, also referred to as AO) as a foaming enhancer. However, as described in JP-A2002-194388 and JP-A2007-23211, a liquid detergent having combination of AES/AO has such problems in stability that viscosity increases during storage and a complex of AES/AO precipitates in storage at a low temperature. To solve the problems, these patent documents describe a method of using an AES having a branched structure.

JP-A5-97633 describes that use of a polyoxypropylene alkyl ether sulfate enables to produce a composition having good foaming properties and good stability at low temperature. JP-A11-507955 discloses an alkylalkoxylated sulfate added with ethylene oxide and/or propylene oxide in an amount of 0.01 to 30 mol. JP-A55-84399, JP-A56-72092, and JP-A56-5895 describe detergent compositions for clothes containing alcohol sulfates added with propylene oxide and ethylene oxide. JP-A56-72092 particularly describes a detergent containing a polyoxyalkylene alkyl ether sulfate produced from a beef tallow-derived higher alcohol and/or a palm oil-derived higher alcohol.

SUMMARY OF THE INVENTION

The present invention provides a liquid detergent composition, containing (a) 4 to 50% by mass of a mixture containing compounds represented by formula (1) having average addition mole numbers m and n of propylene oxide and ethylene oxide satisfying $0<m<1$ and $0<n\leqq 3$, respectively (hereinafter referred to as component (a)); (b) 1 to 30% by mass of an amine oxide surfactant having a hydrocarbon group having 8 to 18 carbon atoms and an alkyl group having 1 to 3 carbon atoms or a hydroxyalkyl group having 1 to 3 carbon atoms (hereinafter referred to as component (b)); a phase stabilizer selected from hydrotrope agents and organic solvents; and water, wherein a mass ratio of (a)/(b) is 20/1 to 1/1:

$$R^{1a}O—(PO)_{m1}(EO)_{n1}SO_3M \quad (1)$$

wherein, $R^{1a}$ represents a linear alkyl group having 8 to 18 carbon atoms in which a carbon atom bound to an oxygen atom is primary; PO and EO represent a propyleneoxy group and an ethyleneoxy group, respectively; m1 and n1 represent addition mole numbers of PO and EO, respectively, which are integers of not less than 0; and M represents a cation.

The present invention provides a method for cleaning dishes by applying the liquid detergent composition to dishes.

DETAILED DESCRIPTION OF THE INVENTION

As described above, in a concentrated liquid detergent containing an AES, a synthetic material-derived AES having a branched alkyl group is conventionally used to solve a problem in storage stability at a low temperature. However, the rising momentum of $CO_2$ emission reduction due to the recent issue of global warming sets numerical targets for the reduction of $CO_2$ emission and recommends reduction of consumption of fossil fuels having the highest impact on $CO_2$ emission and change to alternative natural materials based on a concept of carbon neutrality. Considering such circumstances, synthetic material-derived surfactants, used in industry, are produced principally from an alcohol mixture containing about 20% by mass of an alcohol having a branched alkyl group or a secondary alcohol. This is because, for surfactants produced from alcohols, a mixture of surfactants derived from a branched or secondary alcohol and from a linear alcohol is easier to handle considering gelatinization characteristics when mixed with water and a detergent containing the mixture is more easily designed than that containing only a surfactant derived from a linear alcohol. On the other hand, surfactants produced from natural oil-and-fats, or natural material-derived surfactants contain only a linear alkyl group. A detergent containing a natural material-derived surfactant as a main base is hard to maintain storage stability at low temperature (hereinafter, referred to as low temperature stability). Particularly for a detergent containing an AES produced from a natural material-derived alcohol, when the detergent further contains an AO forming a complex with the AES, low temperature stability thereof is very poor. To use an AES having a linear alkyl group derived from a natural material in a condensed liquid detergent, an issue of stability can be solved by increasing an addition mole number of ethylene oxide. As results, however, hydrophilicity is increased, but a good detergency to oil is impaired.

Therefore, the present invention relates to providing a liquid detergent composition containing an AES produced from a linear alcohol such as a natural material-derived alcohol, and having high detergency and good storage stability at low temperature.

In order to use a polyoxyalkylene alkyl ether sulfate surfactant (AES) having a linear alkyl group derived from a natural material in a liquid detergent, the present inventors have investigated, details of washing behavior of the AES having a linear alkyl group. They have found that AES surfactants having a structure of 1:1 adduct of an alcohol to ethylene oxide (a simple distribution of addition mole number) and having a structure of 1:2 adduct of an alcohol to ethylene oxide (a simple distribution of addition mole number) exhibit the highest detergency in combination use with an amine oxide surfactant. For addition of ethylene oxide to an alcohol, it has been known that a product has a wide distribution of addition mole number of ethylene oxide. For example, when ethylene oxide is added in an average mole number of 2, a product contains an intended 2-mole adduct in an amount of only 15% to 20% by mass but contains unreacted alcohol in an amount of about 30% by mass. The present inventors have also found that an AES produced by sulfating such a product of ethylene oxide addition contains an alkylsulfate (hereinafter, also referred to as AS) in an amount of about 30% by mass, and the AS forms a complex with an AO to precipitate at low temperature to impair stability. This phenomenon is particularly serious for an AES having a linear alkyl group. As described above, by increasing an average addition mole number of ethylene oxide, an amount of the AS in the product of sulfation will decrease to improve stability of the product. However, it was also found that increasing of the average addition mole number will decrease amounts of adduct of 1 mole ethylene oxide and adduct of 2 mole ethylene oxides contributing effectively to detergency, resulting in decreased detergency. The present inventors have found that an oxyalkylene alkyl ether sulfate having a good stability and detergency can be produced by first adding propylene oxide in a small amount to an alcohol to reduce an amount of unreacted alcohol and then adding ethylene oxide to the alcohol. It is expected because the reaction proceeds with the first addition of propylene oxide, without decrease of ratios of adduct of 1 mole ethylene oxide and adduct of 2 mole ethylene oxides. It is considered that the first addition of propylene oxide to the alcohol forms a pseudo-branched structure with an alkyl group and an oxypropylene group bound thereto, which loosens a packing state of the surfactant, to contribute to stability. As above, the present inventors have accomplished the present invention.

The liquid detergent composition of the present invention can exhibit a high detergency and a good storage stability at a low temperature, containing an AES produced from a natural material, or a material composed of a compound having a linear alkyl group, as a starting alcohol.

First, components in the liquid detergent composition of the present invention will be described.

The component (a) of the present invention is a mixture containing compounds represented by formula (1), wherein average addition mole numbers m and n of propylene oxide and ethylene oxide satisfy $0<m<1$ and $0<n\leqq 3$, respectively:

$$R^{1a}O—(PO)_{m1}(EO)_{n1}SO_3M \quad (1)$$

wherein, $R^{1a}$ represents a linear alkyl group having 8 to 18 carbon atoms in which a carbon atom bound to the oxygen atom is primary; PO and EO represent a propyleneoxy group and an ethyleneoxy group, respectively; m1 and n1 represent addition mole numbers of PO and EO, respectively, which are integers of not less than 0; and M represents a cation.

For the component (a) of the present invention, a surfactant produced from a natural material-derived alcohol can be used. In this case, $R^{1a}$ is linear. The natural material-derived alcohol has a hydroxy group at an end, and propylene oxide or ethylene oxide is added to the hydroxy group. Thus, a carbon atom in $R^{1a}$ bound to an oxygen atom of propylene oxide or ethylene oxide is primary. An alkylsulfuric ester or salt is produced by sulfation of the hydroxy group bound to a terminal carbon atom of $R^{1a}$ and the terminal carbon atom is similarly primary.

m and n are average addition mole numbers of the mixture containing the compound of formula (1), and are calculated from m1 and n1 of the compound. In production of the compound in the component (a), a key step of the present invention is the first addition of propylene oxide. Examination of reactivities of ethylene oxide and propylene oxide to be added to an alcohol shows that propylene oxide has higher reactivity. The first addition of propylene oxide thus can reduce an amount of an unreacted alcohol, resulting in a reduced amount of alkylsulfuric ester or salt produced by sulfation of the unreacted alcohol in a final product. When an addition rate of propylene oxide is increased, a percentage of surfactants having a pseudo-branched structure derived from propylene oxide is increased, which affects a packing state of a surfactant adversely due to steric hindrance, resulting in a reduced detergency. Therefore, m, an average addition mole number of propylene oxide, is limited to less than 1, and preferably has the lower limit of 0.1, or $0.1\leqq m$, more preferably has the lower limit of 0.15, or $0.15\leqq m$. m preferably has the upper limit of 0.8, or $m\leqq 0.8$, and more preferably the upper limit of 0.6, or $m\leqq 10.6$.

For the component (a) of the present invention, propylene oxide (hereinafter, also referred to as PO) is first added, and then ethylene oxide (hereinafter, also referred to as EO) is added. Among compounds represented by formula (1), compounds added with 1 and 2 moles of EO, or those having n1=1 and n1=2 are most effective for detergency performance. Thus, ethylene oxide is preferably added such that the component (a) contains adduct of 1 mole and adduct of 2 mole at higher percentages. In the present invention, n, an average addition mole number of EO, is thus preferably not more than 2.5, or $n\leqq 2.5$, more preferably not more than 2.3, or $n\leqq 2.3$, and even more preferably not more than 2, or $n\leqq 2$. The lower limit of n is preferably 0.5, or $0.5\leqq n$, and more preferably 1, or $1\leqq n$.

m1 and n1 of formula (1) will be described below. In the component (a) of the present invention, $0<m<1$ and $0<n\leqq 3$. An amount of compounds of formula (1) in which m1=0 and n1=0 to satisfy is controlled to meet the requirements of the component (a), resulting in a detergent composition having an increased low temperature stability and a sufficient detergency even in a detergent composition containing a surfactant at a high concentration together with an amine oxide surfactant. It is besides considered that other compounds than n1=0, provided $m1\neq 0$, have an oxypropylene group possessing a pseudo-branch factor of the alkyl chain and serve like a branched chain of a synthetic alcohol to improve the low temperature stability.

In the present invention, a percentage of compounds of formula (1) in which m1=n1=0, or alkylsulfuric ester or salt in the component (a) is preferably not more than 28% by mass, more preferably not more than 26% by mass, and even more preferably not more than 24% by mass.

In the present invention, a content of compounds of formula (1) in which $m1\geqq 2$ in the component (a) is preferably not more than 15% by mass, and more preferably not more than 10% by mass. The compounds of $m1\geqq 2$ decreases detergency.

In a reaction of an alcohol with propylene oxide, propylene oxide has a tendency to react more easily with an unreacted alcohol than following PO reacted with the alcohol. When propylene oxide is reacted at a ratio of m<1, compounds of formula (1) in which m1=1 are produced dominantly, and compounds of formula (1) in which m1≧2 in a less amount. Particularly when propylene oxide is reacted at a ratio of m≦0.6, production of compounds of formula (1) in which m1≧2 can be controlled to not more than 15% by mass, and particularly not more than 10% by mass. To control production of the compounds of formula (1) in which m1≧2, a catalyst should be carefully selected. For surely suppressing production of the compounds of formula (1) in which m1≧2, a possible method is to add propylene oxide in the presence of an excess amount of an alcohol. In this case, an excess unreacted alcohol must be distilled off before reacting with ethylene oxide.

Among compounds composing the component (a), an amount of oxypropylene alkyl ether sulfuric ester or salt or compounds of formula (1) in which m1=1 and n1=0 is 4 to 50% by mass, and more preferably 10 to 40% by mass of the component (a).

As described above, in the present invention, the component (a) preferably contains a large amount of compounds having 1 and 2 ethylene oxide groups. An amount of compounds of formula (1) in which n1=1 and n1=2 in the component (a) is thus preferably 25 to 45% by mass, and more preferably 28 to 40% by mass. The rest of the compounds in the component (a) have n1 of not less than 3.

The upper limit of m1 is preferably 3. The component (a) is thus preferably composed of compounds of formula (1) in which 0≦m1≦3. The upper limit of n1 is preferably 10. The component (a) is thus preferably composed of compounds of formula (1) in which 0≦n1≦10. From the viewpoint of detergency, in the present invention, the component (a) is particularly preferably a mixture containing compounds of formula (1) in which 0≦n1≦5 in an amount of not less than 85% by mass.

In formula (1), M represents a cationic group to form a salt. Examples of the cationic group include alkaline metal ions, $—N^+H_4$ (an ammonium ion), and alkanolammonium groups such as a monoethanolammonium group. Examples of the alkaline metal include sodium, potassium, and lithium. Among these metal, sodium and potassium are preferred.

In the present invention, description about mass for the component (a) (% by mass and mass ratio) is based on an assumed mass of the component (a) as that M of the compound of formula (1) is a hydrogen atom (ratio based on acid).

In some cases, the component (a) may contain an unsulfated compound in production thereof. In the present invention, the unsulfated compound is considered as a nonionic surfactant.

The component (a) can be produced as follows.

step (I): adding propylene oxide to a linear primary alcohol step (II): adding ethylene oxide to the propylene oxide adduct prepared in the step (I)

step (III): sulfating the alkoxylate produced in the step (II) followed by neutralizing In the step (I), propylene oxide is added to the linear primary alcohol having 8 to 18 carbon atoms at an addition rate of propylene oxide as shown by m of formula (1) per mole of the alcohol.

In the step (II), ethylene oxide is added on the average to the propylene oxide adduct prepared in the step (I) at a rate of ethylene oxide as shown by n in formula (1) per mole of the alcohol.

The steps (I) and (II) can be conducted by a known method, or by placing an alcohol and KOH as a catalyst in an amount of 0.5 to 1% by mole to the alcohol in an autoclave, heating to dehydrate, and adding a given amount of propylene oxide or ethylene oxide to react at about 120 to 160° C. In these steps, a mode of addition is block addition. These steps must be conducted in an order of addition of propylene oxide [the step (I)] and addition of ethylene oxide [the step (II)]. The autoclave used is preferably equipped with a stirrer, a temperature controller, and an automatic introduction device.

In the step (III), the alkoxylate produced in the step (II) is sulfated and neutralized. Examples of a method for sulfation include sulfating with sulfur trioxide (liquid or gas), sulfur trioxide-containing gas, fuming sulfuric acid, and chlorosulfonic acid. From the viewpoint of prevention of generation of waste sulfuric acid and waste hydrochloric acid, particularly preferred is a method of continuously supplying sulfur trioxide in the state of gas or liquid together with the alkoxylate.

Examples of a method for neutralizing a sulfated product include a batch method of adding the sulfated product to a given amount of a neutralizer and stirring to neutralize, and a loop method of continuously supplying the sulfated product and a neutralizer in a pipe and neutralizing with stirring with a stirrer-mixer. In the present invention, the method for neutralizing is not specifically limited. Examples of the neutralizer used in the step include alkaline metal aqueous solutions, ammonia water, and triethanolamine. Preferred are alkaline metal aqueous solutions, and more preferred is sodium hydroxide.

The component (b) of the present invention is an amine oxide surfactant having a hydrocarbon group having 10 to 18 carbon atoms and an alkyl group having 1 to 3 carbon atoms or a hydroxyalkyl group having 1 to 3 carbon atoms. The amine oxide surfactant exhibits good detergency for oil stains in combination use with the AES of the component (a). The amine oxide surfactant is preferably a compound represented by formula (2):

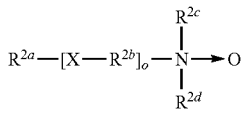

(2)

wherein, $R^{2a}$ represents a hydrocarbon group having 10 to 18 carbon atoms; $R^{2b}$ represents an alkylene group having 1 to 3 carbon atoms; $R^{2c}$ and $R^{2d}$ each represent an alkyl or hydroxyalkyl group having 1 to 3 carbon atoms; X represents a group selected from —COO—, —CONH—, and —O—; and o represents the number of 0 or 1.

In the compound represented by formula (2), $R^{2a}$ preferably represents an alkyl or alkenyl group having 10 to 16 carbon atoms, and more preferably 10 to 14 carbon atoms. Specific examples of the preferred compound include those in which $R^{2a}$ is a lauryl group (or lauric acid residue) and/or a myristyl group (myristic acid residue), $R^{2c}$ and $R^{2d}$ are methyl groups, and o=0, and those in which $R^{2a}$ is a lauryl group (or lauric acid residue) and/or a myristyl group (myristic acid residue), $R^{2c}$ and $R^{2d}$ are methyl groups, o=1, X is —CONH— or —O—, and $R^{2b}$ is a propylene group or a hydroxypropylene group.

In the present invention, $R^{2a}$ may represent a single alkyl (or alkenyl) chain or a mixed alkyl (or alkenyl) group having different alkyl (or alkenyl) chains. In the latter case, the mixed alkyl group (alkenyl) is preferably a mixed alkyl (or alkenyl) chain derived from a vegetable oil selected from palm oil and palm kernel oil. In particular, from the viewpoint of effects of detergency, the mixed alkyl group contains a lauryl group (lauric acid residue) and a myristyl group (myristic acid residue) at a molar ratio of lauryl/myristyl of 95/5 to 20/80, and more preferably 90/10 to 30/70.

The liquid detergent composition of the present invention preferably further contains at least one surfactant as other component (hereinafter, referred to as the component (c)) selected from nonionic surfactants, amphoteric surfactants, and anionic surfactants other than the component (a) for stability and detergency.

Preferred examples of the nonionic surfactant include monoalkyl (poly)glyceryl ether having a branched alkyl group having 6 to 12 carbon atoms. Particularly preferred are those represented by formula (3):

$$R^3—O—X \quad (3)$$

wherein, $R^3$ represents a branched alkyl group having 8 to 12 carbon atoms and preferably a group selected from 2-ethylhexyl, isononyl, and isodecyl; and, X represents $CH_2CH(OH)CH_2OH$.

Preferred examples of the nonionic surfactant include polyoxyethylene alkyl ethers produced by adding ethylene oxide to linear and branched primary and secondary alcohols having 8 to 20 carbon atoms. Particularly preferred are those represented by formula (4):

$$R^4—O(EO)_rH \quad (4)$$

wherein, $R^4$ represents a primary linear alkyl group, a primary branched alkyl group or a secondary alkyl group, having 8 to 20 carbon atoms, preferably 8 to 18 carbon atoms on the average; EO represents an ethyleneoxy group; and, r represents an average addition mole number ranging from 5 to 20.

Preferred examples of the nonionic surfactant include polyoxyethylene polyoxypropylene alkyl ethers produced by adding propylene oxide and ethylene oxide to linear and branched primary and secondary alcohols having 8 to 20 carbon atoms. In ethers, oxyethylene groups and oxypropylene groups may be arranged in a block or random mode in any order. Particularly preferred are those represented by formula (5):

$$R^5—O[(EO)_p/(PO)_q]H \quad (5)$$

wherein, $R^5$ represents a primary alkyl group having 8 to 20 carbon atoms and preferably 8 to 18 carbon atoms; EO represents ethylene oxide group; PO represents propylene oxide group; p represents an average addition mole number ranging from 3 to 15; q represents an average addition mole number ranging from 1 to 5; and, EO and PO is randomly added or EO is added and then PO is added, or an adduct of PO and EO in the reverse order thereto to form a block adduct may be used.

Examples of the nonionic surfactant that can be used together further include alkyl glucosides. A small amount of compounds represented by formulae (4) and (5) and produced by first adding propylene oxide may be contained in the component (a) as unreacted compounds when the sulfation is insufficient. In the present invention, combination use of a monoalkyl glyceryl ether, in particular the compound represented by formula (3) significantly increases detergency and also rinsing properties.

For the amphoteric surfactant, sulfobetaine and carbobetain can be used.

The anionic surfactant other than the component (a) preferably has an alkyl group having 10 to 20 carbon atoms and a sulfate or sulfonate group. Specific examples thereof include linear alkylbenezenesulfonate, α-sulfofatty acid ester salts, α-olefin sulfonates, alkanesulfonates, and fatty acid salts. A polyoxyethylene alkyl ether sulfate that does not satisfy the conditions of $R^{1a}$ shown in the component (a) may be used. The polyoxyethylene alkyl ether sulfate may be derived from a synthetic alcohol. When the polyoxyethylene alkyl ether sulfate contains a compound satisfying the conditions for the component (a), or the conditions of $R^{1a}$, however, the polyoxyethylene alkyl ether sulfate must be added within the range of the conditions for the component (a).

In the present invention, the component (a) is characterized by the conditions as that $R^{1a}$ is an alkyl group fully derived from a natural source, or $R^{1a}$ is linear and has a primary carbon atom bound to an oxygen atom. As described above, other synthetic material-derived AES can be used together within the range that does not fail the conditions for the component (a). However, in this case, the component (a) mixed with a synthetic material-derived AES may be not distinguished clearly from AES fully derived from synthetic sources, because some AES derived from synthetic sources also contain a compound satisfying the conditions of $R^{1a}$ in a certain amount according to a process of production.

In the present invention, to emphasize the features of the present invention and accentuate differences from conventional AES derived from synthetic alcohols, percentages of AES having characteristics of that derived from a synthetic alcohol are limited so that differences between natural material-derived AES and synthetic material-derived AES can be accentuated. AES derived from a synthetic alcohol includes AES having a branched alkyl group and having a linear alkyl group bound to an oxygen atom at a carbon atom other than a primary carbon atom in the alkyl group, in other words, AES having a branched alkyl group and AES derived from linear secondary alcohols. More specifically, in a total AES produced from a synthetic alcohol under general conditions, an amount of an AES derived from the branched alcohol or the secondary alcohol is about 20 to 100% by mass. In the liquid detergent composition of the present invention, the component (a) can have differences from AES derived from synthetic sources by limiting the total amount of (1) an AES having a branched alkyl group and (2) an AES having a linear alkyl group bound to an oxygen atom at a secondary carbon atom of the alkyl group in the whole AES of the liquid detergent composition to less than 20% by mass, more preferably not more than 15% by mass, even more preferably not more than 10% by mass, even more preferably substantially free.

The liquid detergent composition of the present invention further contains a phase stabilizer selected from a hydrotrope agent [hereinafter, also referred to as the component (d)] and an organic solvent [hereinafter, also referred to as the component (e)].

For the hydrotrope agent of the component (d), preferred are alkylbenzenesulfonic acid salts having 1 to 3 alkyl groups each having up to 3 carbon atoms. Specifically preferred are toluenesulfonic acid, xylenesulfonic acid and cumenesulfonic acid, and sodium salt, potassium salt and magnesium salts of the acids. Particularly preferred is p-toluenesulfonic acid.

Examples of the organic solvent of the component (e) include (i) alcohols having 1 to 3 carbon atoms; (ii) glycols and glycerols having 2 to 4 carbon atoms; (iii) di- and trialkylene glycols in which an alkylene glycol unit has 2 or 4 carbon atoms; and (iv) di- and tetraalkylene glycol monoalkoxy (methoxy, ethoxy, propoxy, butoxy), phenoxy, and benzoxy ethers in which an alkylene glycol unit has 2 or 4 carbon atoms.

Specific examples thereof include (i) ethanol and isopropyl alcohol; (ii) ethylene glycol, propylene glycol, glycerol, and isoprene glycol; (iii) diethylene glycol and dipropylene glycol; and (iv) propylene glycol monomethyl ether, propylene glycol monoethyl ether, diglycol monobutyl ether, phenoxyethanol, phenoxytriethylene glycol, and phenoxyisopropanol. Among them, water-soluble organic solvents are preferred. Specifically preferred are ethanol, propylene glycol, dipropylene glycol, butyldiglycol, phenoxyethanol, phenyl glycol, and phenoxyisopropanol.

For the organic solvent, polyalkylene glycols can be used. Polyalkylene glycols act effectively as an anti-gelling agent [hereinafter, also referred to as component (e-1)]. From the viewpoints of viscosity control and storage stability, anti-gelling polymers, for example those described in JP-A11-513067, and particularly polypropylene glycol are preferably added. Polypropylene glycol used preferably has a weight average molecular weight of 600 to 5000, and more preferably 1000 to 4000. A weight average molecular weight can be determined by light scattering and measured with a dynamic light scattering spectrophotometer (DLS-8000 series, Otsuka Electronics Co., Ltd.) or the like.

To suppress formation of a polymerized film of surfactants in a gas-liquid interface of the detergent composition, a glycerol-ethylene oxide adduct may be added as the component (e).

The liquid detergent composition of the present invention may contain citric acid, malic acid, EDTA (ethylenediaminetetraacetic acid), tartaric acid, lactic acid, gluconic acid, an aminopolycarboxylic acid produced by bonding one or more carboxymethyl groups to a nitrogen atom of an amino acid compound [e.g., MGDA (methylglycine diacetic acid)] and salts thereof as a sequestering agent [hereinafter, referred to as component (f)]. Examples of the salt include sodium, potassium, and alkanolamine salts. These may be added as other alkali agent.

The liquid detergent composition of the present invention may further contain a compound known to be added to a liquid detergent as other component such as a bactericidal and fungicidal agent (e.g., commercial products known as Proxel and Kathon), an antibacterial agent (e.g., zinc salts, silver salts, polylysines, and phenoxyethanol), a water-soluble inorganic salt (e.g., magnesium sulfate), a reducing agent (e.g., sulfites), an antioxidant (e.g., BHT and ascorbic acid), a thickening polymer (e.g., xanthan gum, guar gum, and carrageenan), a polymer dispersant (e.g., polyacrylic acid polymers), an enzyme (e.g., protease, amylase, and lipase), a foaming booster, a colorant, and a perfume.

The rest of the liquid detergent composition of the present invention is water. It is a substantially essential component. For liquid stability, distilled water or deionized water is preferably used.

Next, amounts of the components described above in the liquid detergent composition of the present invention will be described. An amount of the component (a) in the liquid detergent composition of the present invention is 4 to 50% by mass, preferably 10 to 40% by mass, more preferably 4 to 30% by mass, and more preferably 10 to 30% by mass. From the viewpoint of detergency, the amount is not less than the lower limit, and from the viewpoint of low temperature stability, not more than the upper limit. The amount of the component (a) is a concentration determined by assuming that M in formula (1) represents a hydrogen atom.

An amount of the component (b) in the liquid detergent composition of the present invention is 1 to 30% by mass, preferably 1 to 20% by mass, and more preferably 1.5 to 15% by mass. From the viewpoint of detergency, the amount is not less than the lower limit, and from the viewpoint of low temperature stability, not more than the upper limit.

In combination use, the component (a) and the component (b) together form a complex to enhance effects particularly at high concentration. To form the complex, a ratio of the component (a) to the component (b) is (a)/(b)=20/1 to 1/1, preferably 10/1 to 1/1, and more preferably 10/1 to 2/1, based on mass. From the viewpoint of low temperature stability, the ratio is not less than the lower limit, and from the viewpoint of detergency, not more than the upper limit.

An amount of the component (c) in the liquid detergent composition of the present invention is 5 to 25% by mass, and more preferably 5 to 20% by mass. From the viewpoints of emulsifying/foaming power, the component (c) preferably contains a nonionic surfactant other than the component (b) in an amount of 0.5 to 15% by mass of the detergent composition. From the viewpoints of foaming properties and low temperature stability, the component (c) preferably contains an amphoteric surfactant in an amount of 2 to 15% by mass of the detergent composition. The component (c) may further contain an anionic surfactant other than the component (a). However, most of sulfate surfactants, such as linear alkylbenzenesulfonates and alkanesulfonates, are derived from synthetic materials. From the technical viewpoint of utilization of the natural material-derived AES in the present invention, an amount of anionic surfactants other than the component (a) are preferably limited, specifically to less than 5% by mass, more preferably not more than 3% by mass, and even more preferably not more than 2.5% by mass of the liquid detergent composition.

In the present invention, the total amount of surfactants including the components (a), (b), and (c) is preferably 10 to 60% by mass, and more preferably 10 to 50% by mass. A ratio of a total of the components (a) and (b) to the whole surfactants is preferably 40 to 90% by mass, and more preferably 40 to 85% by mass.

An amount of the hydrotrope agent of the component (d) in the liquid detergent composition of the present invention is preferably 1.5 to 10% by mass, and more preferably 2 to 7.5% by mass.

An amount of the organic solvent of the component (e) in the liquid detergent composition of the present invention is preferably 0 to 30% by mass, and more preferably 1.5 to 15% by mass excluding an amount of the component (e-1) described below. An amount of ethanol in the liquid detergent composition is preferably 0 to 7.5% by mass. The liquid detergent composition preferably further contains one or two or more additional solvents selected from propylene glycol, dipropylene glycol, butyldiglycol, phenoxyethanol, phenyl glycol, and phenoxyisopropanol. The total amount of one or two or more solvents selected from propylene glycol, dipropylene glycol, butyldiglycol, phenoxyethanol, phenyl glycol and phenoxyisopropanol may be 0 to 25% by mass of the liquid detergent composition.

In the component (e), an amount of an anti-gelling polymer as the component (e-1) is preferably 0 to 5% by mass, and more preferably 0 to 3% by mass of the liquid detergent composition. When the component (e-1) is polypropylene glycol, an amount thereof is preferably 0 to 2% by mass of the liquid detergent composition.

In the present invention, the rest is water. An amount of water is not more than 85% by mass, and more preferably 80 to 30% by mass of the liquid detergent composition, considering other components.

The liquid detergent composition of the present invention has a pH of 4.5 to 9, and preferably 5.5 to 8 at 25° C. Considering that the amine oxide of the component (b) has a cationization degree varied depending on pH and the component (a) is unstable under acidic conditions, the lower limit of the pH is set from the viewpoint of low temperature stability and the upper limit is set from the viewpoint of detergency. To regulate a pH to acidic, inorganic acids such as hydrochloric acid and sulfuric acid, chelating agents such as citric acid, and hydrotrope agents can be used. To regulate to alkali, alkali agents such as alkanolamine and alkaline metal hydroxides can be used. In the present invention, a pH is measured according to the method described in Examples below.

From the viewpoint of dischargeability, a viscosity of the liquid detergent composition of the present invention is preferably 10 to 1000 mPa·s, and more preferably 25 to 500 mPa·s. A viscosity is measured at 20° C. with a Brookfield viscometer using a No. 2 rotor at a rotation number of 60 r/min. A viscosity after 60 seconds from starting of rotation is considered as a viscosity of the liquid detergent composition.

EXAMPLES

The following Examples demonstrate the present invention. Examples are intended to illustrate the present invention and not to limit the present invention.

Examples 1 to 6 and Comparative Examples 1 to 6

Following components (a) and components shown in Table 2 were used to prepare liquid detergent compositions. In preparation, pH was regulated with 48% sodium hydroxide (in Table 1, shown as "+"). A pH value was measured as described below. Prepared compositions were evaluated for detergency according to the following method. Results are collectively shown in Table 2. The components (a) used [some compounds were for comparison] were as follows. Natural material-derived alcohols used below are composed only of compounds having linear alkyl groups.

ES1: a natural material-derived alcohol in which a ratio of alkyl chains was $C_{12}$:$C_{14}$=73:27 (mass ratio) was added with 0.4 mol of PO and 1.5 mol of EO, sulfated with sulfur trioxide, and neutralized with sodium hydroxide (so that a reaction mixture diluted with water by 10% had pH 11).

ES2: a natural material-derived alcohol in which a ratio of alkyl chains was $C_{12}$:$C_{14}$=73:27 (mass ratio) was added with 0.5 mol of PO and 1.5 mol of EO, sulfated with sulfur trioxide, and neutralized with sodium hydroxide (so that a reaction mixture diluted with water by 10% had pH 11).

ES3: a natural material-derived alcohol in which a ratio of alkyl chains was $C_{12}$:$C_{14}$=73:27 (mass ratio) was added with 0.6 mol of PO and 1.5 mol of EO, sulfated with sulfur trioxide, and neutralized with sodium hydroxide (so that a reaction mixture diluted with water by 10% had pH 11).

ES4: a natural material-derived alcohol in which an alkyl chain was $C_{12}$ was added with 0.4 mol of PO and 2.0 mol of EO, sulfated with sulfur trioxide, and neutralized with sodium hydroxide (so that a reaction mixture diluted with water by 10% had pH 11).

ES5: a natural material-derived alcohol in which a ratio of alkyl chains was $C_{12}$:$C_{14}$=73:27 (mass ratio) was added with 2.0 mol of EO, sulfated with sulfur trioxide, and neutralized with sodium hydroxide (so that a reaction mixture diluted with water by 10% had pH 11).

ES6: a natural material-derived alcohol in which an alkyl chain was $C_{12}$ was added with 4.0 mol of EO, sulfated with sulfur trioxide, and neutralized with sodium hydroxide (so that a reaction mixture diluted with water by 10% had pH 11).

ES7: a natural material-derived alcohol in which a ratio of alkyl chains was $C_{12}$:$C_{14}$=73:27 (mass ratio) was added with 0.5 mol of PO and 3.5 mol of EO, sulfated with sulfur trioxide, and neutralized with sodium hydroxide (so that a reaction mixture diluted with water by 10% had pH 11).

ES8: a natural material-derived alcohol in which a ratio of alkyl chains was $C_{12}$:$C_{14}$=73:27 (mass ratio) was added with 2.0 mol of PO and 1.0 mol of EO, sulfated with sulfur trioxide, and neutralized with sodium hydroxide (so that a reaction mixture diluted with water by 10% had pH 11).

ES9: a natural material-derived alcohol in which a ratio of alkyl chains was $C_{12}$:$C_{14}$=73:27 (mass ratio) was added with 2.0 mol of PO and 2.0 mol of EO, sulfated with sulfur trioxide, and neutralized with sodium hydroxide (so that a reaction mixture diluted with water by 10% had pH 11).

ES1 to ES9 are summarized in detail in Table 1.

TABLE 1

| Referential code | Average addition mole number m | Average addition mole number n | Content of component (a) (mass-%): Compound of formula (1) in which m1 = n1 = 0 | Compound of formula (1) in which m1 ≧ 2 | Compound of formula (1) in which m1 = 1 and n1 = 0 | Compound of formula (1) in which n1 = 1 and n1 = 2 |
|---|---|---|---|---|---|---|
| ES1 | 0.4 | 1.5 | 21.5 | 2.7 | 20.0 | 33.4 |
| ES2 | 0.5 | 1.5 | 17.8 | 4.8 | 21.9 | 31.7 |
| ES3 | 0.6 | 1.5 | 15.5 | 6.9 | 24.5 | 31.3 |
| ES4 | 0.4 | 2.0 | 16.1 | 2.8 | 17.0 | 31.3 |
| ES5 | — | 2.0 | 28.5 | 0 | 0 | 35.5 |
| ES6 | — | 4.0 | 7.0 | 0 | 0 | 0 |
| ES7 | 0.5 | 3.5 | — | — | — | — |
| ES8 | 2.0 | 1.0 | — | — | — | — |
| ES9 | 2.0 | 2.0 | — | — | — | — |

<Method of Measuring pH>

A pH meter (HORIBA, pH/ion meter F-23) was connected to a composite electrode for measuring pH(HORIBA, a glass frosted sleeve type) and turned on. For a pH electrode internal liquid, a saturated aqueous potassium chloride solution (3.33 mol/L) was used.

Next, standard liquids of pH 4.01 (phthalate standard), pH 6.86 (neutral phosphate standard), and pH 9.18 (borate standard) were individually filled in a 100 ml beaker and soaked in a thermostatic bath for 30 minutes at 25° C. The composite electrode for measuring pH was soaked in the standard liquids regulated to the constant temperature for three minutes in order of pH 6.86→pH 9.18→pH 4.01 each to be calibrated.

A sample (liquid detergent composition) was filled in a 100 ml beaker and placed in a thermostatic bath at 25° C. to regulate to 25° C. In the sample regulated to the constant temperature was inserted the composite electrode for measuring pH for three minutes to measure a pH.

<Test for Detergency>

Rapeseed oil and beef tallow were mixed at a mass ratio of 1/1. To a mixture was added 0.1% by mass of dye (Sudan Red) homogeneously to produce an oil stain model. 1 g of the oil stain model was spread over a ceramic dish to give a dirty dish model. On a commercial sponge (Sumitomo 3M Limited, Scotch-Brite) were applied with 1 g of a composition in Table 2 and 30 g of tap water. The sponge was squeezed twice to thrice with a hand to make lather, and used to rub the stained dish model. The number of dishes cleaned (confirmed by disappear of the color on a dish) was determined.

<Low Temperature Stability (1)>

250 ml each of liquid detergent compositions of Table 2 were individually filled in a special PET bottle for dishwashing detergent, stored for 20 days at −5° C., and compared with clear uniform liquid detergent compositions immediately after preparation. Change in appearance of a liquid was evaluated by the following criteria.

No change in appearance . . . ○

Changed appearance such as gelation, separation, and precipitation . . . x

TABLE 2

| | | | | Example 1 | 2 | 3 | 4 | 5 | 6 |
|---|---|---|---|---|---|---|---|---|---|
| Liquid detergent composition | Compounded component (mass %) | (a) | ES1 | 17 | | 13 | 13 | | |
| | | | ES2 | | | | | 13 | |
| | | | ES3 | | | | | | 13 |
| | | | ES4 | | 17 | | | | |
| | | | ES5 | | | | | | |
| | | | ES6 | | | | | | |
| | | | ES7 | | | | | | |
| | | | ES8 | | | | | | |
| | | | ES9 | | | | | | |
| | | (b) | APAO | 1.8 | 1.8 | 0.3 | | | |
| | | | AO1 | 1.8 | 1.8 | 4 | 4 | 4 | 4 |
| | | | AO2 | | | 1 | 1 | 1 | 1 |
| | | (c) | Sulfobataine | 4 | 4 | 5 | 5 | 5 | 5 |
| | | | Potassium alkenylsuccinate | 1 | 1 | | 1 | 1 | 1 |
| | | | Nonion 1 | 3 | 3 | 3 | 4 | 4 | 4 |
| | | | Nonion 2 | | | 4 | | | |
| | | | GE-2EH | 3.5 | 3.5 | | 3 | 3 | 3 |
| | | (d) | P-toluenesulfonic acid | 4 | 4 | 2.5 | 4 | 4 | 4 |
| | | (e-1) | Polypropylene glycol | 1 | 1 | | 1 | 1 | 1 |
| | | (e) | Ethanol | 6 | 6 | 7 | 6 | 6 | 6 |
| | | | Propylene glycol | 1 | 1 | | 1 | 1 | 1 |
| | | | Phenoxy ethanol | 1 | 1 | | 1 | 1 | 1 |
| | | | PhG-30 | 1 | 1 | | 1 | 1 | 1 |
| | | | Citric acid | 5 | 5 | 0.3 | 5 | 5 | 5 |
| | | | Preservative | 0.02 | 0.02 | 0.02 | 0.02 | 0.02 | 0.02 |
| | | | Zinc sulfate | | | 0.3 | | | |

TABLE 2-continued

| | | | | | | | |
|---|---|---|---|---|---|---|---|
| heptahydrate | | | | | | | |
| NaOH | | + | + | + | + | + | + |
| Perfume | | 0.5 | 0.5 | 0.3 | 0.5 | 0.5 | 0.5 |
| Ion-exchanged water | | Balance | Balance | Balance | Balance | Balance | Balance |
| Total | | 100 | 100 | 100 | 100 | 100 | 100 |
| pH | | 5.5 | 5.5 | 6.8 | 6.7 | 6.7 | 6.7 |
| Low temperature stability (−5° C., for 20 days) | | ○ | ○ | ○ | ○ | ○ | ○ |
| Number of cleaned dishes (sheet) | | 10 | 10 | 9 | 10 | 10 | 9 |

| | | | Comparative example | | | | | |
|---|---|---|---|---|---|---|---|---|
| | | | 1 | 2 | 3 | 4 | 5 | 6 |
| Liquid detergent composition | Compounded component (mass %) | (a) ES1 | | | | | | |
| | | ES2 | | | | | | |
| | | ES3 | | | | | | |
| | | ES4 | | | | | | |
| | | ES5 | 17 | | 13 | | | |
| | | ES6 | | 13 | | | | |
| | | ES7 | | | | 13 | | |
| | | ES8 | | | | | 13 | |
| | | ES9 | | | | | | 13 |
| | | (b) APAO | 1.8 | 0.3 | | | | |
| | | AO1 | 1.8 | 4 | 4 | 4 | 4 | 4 |
| | | AO2 | | 1 | 1 | 1 | 1 | 1 |
| | | (c) Sulfobataine | 4 | 5 | 5 | 5 | 5 | 5 |
| | | Potassium alkenylsuccinate | 1 | | 1 | 1 | 1 | 1 |
| | | Nonion 1 | 3 | 3 | 4 | 4 | 4 | 4 |
| | | Nonion 2 | | 4 | | | | |
| | | GE-2EH | 3.5 | | 3 | 3 | 3 | 3 |
| | | (d) P-toluenesulfonic acid | 4 | 2.5 | 4 | 4 | 4 | 4 |
| | | (e-1) Polypropylene glycol | 1 | | 1 | 1 | 1 | 1 |
| | | (e) Ethanol | 6 | 7 | 6 | 6 | 6 | 6 |
| | | Propylene glycol | 1 | | 1 | 1 | 1 | 1 |
| | | Phenoxy ethanol | 1 | | 1 | 1 | 1 | 1 |
| | | PhG-30 | 1 | | 1 | 1 | 1 | 1 |
| | | Citric acid | 5 | 0.3 | 5 | 5 | 5 | 5 |
| | | Preservative | 0.02 | 0.02 | 0.02 | 0.02 | 0.02 | 0.02 |
| | | Zinc sulfate heptahydrate | | 0.3 | | | | |
| | | NaOH | + | + | + | + | + | + |
| | | Perfume | 0.5 | 0.3 | 0.5 | 0.5 | 0.5 | 0.5 |
| | | Ion-exchanged water | Balance | Balance | Balance | Balance | Balance | Balance |
| | | Total | 100 | 100 | 100 | 100 | 100 | 100 |
| | | pH | 5.5 | 6.8 | 6.7 | 6.7 | 6.7 | 6.7 |
| | | Low temperature stability (−5° C., for 20 days) | X | ○ | X | ○ | ○ | ○ |
| | | Number of cleaned dishes (sheet) | 10 | 5 | 10 | 5 | 6 | 5 |

In Table 2, used components were as follows.

APAO: lauric acid aminopropyl-N,N-dimethylamine oxide

AO1: N-lauryl-N,N-dimethylamine oxide

AO2: N-decyl-N,N-dimethylamine oxide/N-myristyl-N,N-dimethylamine oxide=2/3 (mass ratio)

sulfobetaine: lauryl dimethyl sulfobetaine potassium alkenylsuccinate: the alkenyl group had 12 carbon atoms nonion 1: an alkyl glucoside having a mixed alkyl group composed of $C_{12}/C_{14}$=60/40 (mass ratio) and an average glucoside condensation degree of 1.5 nonion 2: Softanol 70H (Nippon Shokubai Co., Ltd.)

GE-2EH: 2-ethylhexyl monoglyceryl ether (monoglyceryl ether: 99% by mass)

polypropylene glycol: having an average molecular weight of 1000

PhG-30: polyoxyethylene monophenyl ether (Nippon Nyukazai Co., Ltd., average addition mole number of EO: 3.0 mol)

preservative: Proxel BDN (Avecia)

Example 7 and Comparative Example 7

Liquid detergent compositions in Table 3 (components used were the same as those in Table 2) were prepared. 250 ml each of liquid detergent compositions was individually filled in a special PET bottle for dishwashing detergent, stored for 1 day at −5° C., and compared with clear uniform liquid detergent compositions immediately after preparation. Change in appearance of a liquid was evaluated by the same criteria as that of low temperature stability (1). Results are shown in Table 3.

TABLE 3

| | | | | Example 7 | Comparative example 7 |
|---|---|---|---|---|---|
| Liquid detergent composition | Compounded composition (mass-%) | (a) | ES1 | 18 | |
| | | | ES5 | | 18 |
| | | (b) | AO1 | 4 | 4 |
| | | (d) | p-toluene sulfonic acid | 3 | 3 |
| | | (e) | Ethanol | 6.5 | 6.5 |
| | | | Citric acid | 1 | 1 |
| | | | NaOH | 0.8 | 0.8 |
| | | | Ion-exchanged water | Balance | Balance |
| | | | Total | 100 | 100 |
| | | | pH | 6.6 | 6.6 |
| | Low temperature stability (−5° C., for 1 day) | | | ○ | X |

The invention claimed is:

1. A liquid detergent composition comprising:

(a) 4 to 50% by mass of a mixture comprising compounds represented by formula (1) having average addition mole numbers m and n of propylene oxide and ethylene oxide satisfying $0.15 \leqq m \leqq 0.8$ and $1 \leqq n \leqq 2.3$, respectively;

(b) 1 to 30% by mass of an amine oxide surfactant having a hydrocarbon group having 8 to 18 carbon atoms and an alkyl group having 1 to 3 carbon atoms or a hydroxyalkyl group having 1 to 3 carbon atoms;

a phase stabilizer selected from the group consisting of hydrotrope agents and organic solvents; and water;

wherein a mass ratio of (a)/(b) is 10/1 to 2/1:

$$R^{1a}O—(PO)_{m1}(EO)_{n1}SO_3M \quad (1)$$

wherein, $R^{1a}$ represents a linear alkyl group having 8 to 18 carbon atoms, in which a carbon atom bound to an oxygen atom is primary; PO and EO represent a propyleneoxy group and an ethyleneoxy group, respectively; m1 and n1 represent addition mole numbers of PO and EO, respectively, which are integers of not less than 0; and M represents a cation.

2. The liquid detergent composition according to claim 1, further comprising a component (c) comprising a nonionic surfactant, an amphoteric surfactant and an anionic surfactant other than the component (a) in which a total amount of surfactants (c) is 10 to 60% by mass.

3. The liquid detergent composition according to claim 1, wherein the total of the components (a) and (b) based on the total of all the surfactants is 40% to 90% by mass.

4. A method for cleaning a kitchenware, comprising applying the liquid detergent composition according to claim 1 to the kitchenware.

* * * * *